US005720506A

United States Patent [19]

Arabia, Jr. et al.

[11] Patent Number: 5,720,506

[45] Date of Patent: Feb. 24, 1998

[54] VEHICLE DOOR LATCH

[75] Inventors: Frank Joseph Arabia, Jr., Macomb Township, Mich.; Colby Lenn Bellew, Berkeley, Calif.; Ian Martin, Pontiac, Mich.

[73] Assignee: General Motors Corporation, Detroit, Mich.

[21] Appl. No.: 756,020

[22] Filed: Nov. 26, 1996

[51] Int. Cl.[6] ..... E05C 3/06; E05C 3/16

[52] U.S. Cl. ..... 292/216; 292/225; 292/DIG. 25; 70/256

[58] Field of Search ..... 292/125, 196, 292/200, 216, 217, 225, DIG. 25; 70/256, 257; 74/471 R, 502.4

[56] References Cited

U.S. PATENT DOCUMENTS

| | | | |
|---|---|---|---|
| 4,045,064 | 8/1977 | Okada | 292/125 |
| 4,633,724 | 1/1987 | Mochida | 74/471 R |
| 4,756,563 | 7/1988 | Garwood et al. | 292/216 |
| 5,531,489 | 7/1996 | Cetnar | 292/DIG. 25 |
| 5,647,234 | 7/1997 | Foster | 70/256 |

*Primary Examiner*—Neill R. Wilson

*Attorney, Agent, or Firm*—Lawrence B. Plant

[57] ABSTRACT

A vehicle door latch and handle mechanism including a cable-driven door latch wherein a sheath encasing a cable pushes on a trigger in the latch mechanism to actuate a latchbolt and cause it to disengage a striker. Tensioning of the cable causes the sheath thereabout to straighten and push upon the trigger for the latch.

5 Claims, 1 Drawing Sheet

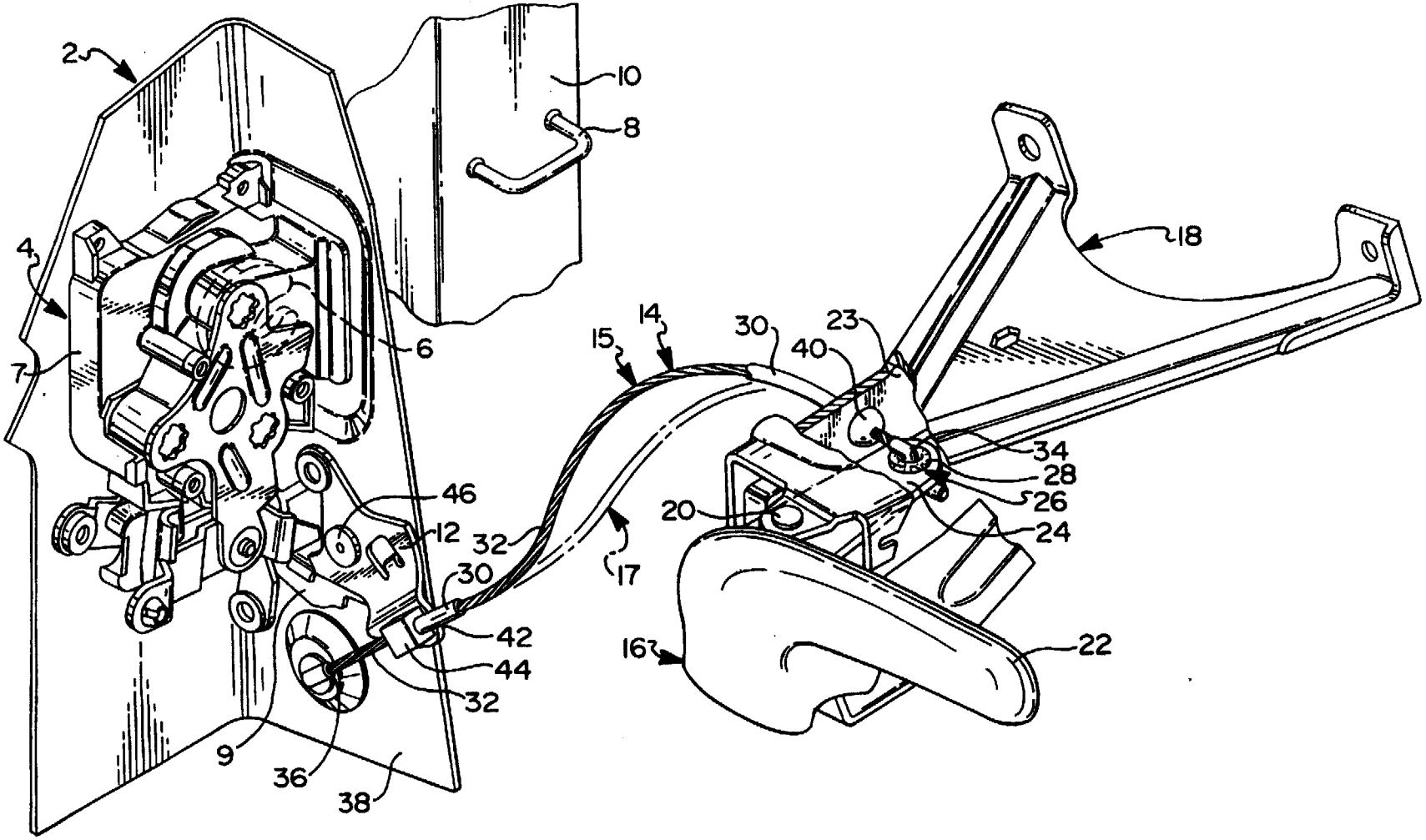
18
22
34
28
26
24
23
40
30
20
14
15
17
16
10
8
32
30
42
44
32
46
12
6
38
36
9
2
4
7

VEHICLE DOOR LATCH

TECHNICAL FIELD

This invention relates generally to door latches for vehicles, and more particularly to such latches which are actuated by a cable system coupled to a door handle located remotely from the latch.

BACKGROUND OF THE INVENTION

Vehicle door latches are well known in the art and serve to prevent unintended opening of the door. Latching mechanisms comprise various combinations of springs, gears, cams, levers, pivots and other such linkages, coacting to provide latching, unlatching, locking and unlocking functions, which mechanisms are well known in the art. The structural details of such mechanisms and arrangements of such linkages can be found in numerous patents such as Garwood U.S. Pat. No. 4,756,563 and copending U.S. patent application U.S. Ser. No. 08/707,467 filed Sep. 4, 1996, both of which are assigned to the assignee of the present invention. Moreover, such mechanisms can be found in latches sold commercially by the General Motors Corporation, assignee of the present invention, as well as other vehicle manufacturers. The aforesaid patents and commercial latches are intended to be incorporated herein by reference.

It is also well known to actuate such door latches by a flexible cable system which includes a cable encased in a flexible sheath and is coupled to a handle located remotely from the latch (hereafter cable-driven latches). Cable-driven latches typically include a latchbolt (e.g., a rotateable fork-bolt) for engaging a striker on doorway frame. The latchbolt is actuated by a trigger which in turn is actuated by the cable, one end of which is attached to the trigger and the other end of which is attached to the door handle. Pulling or rotating the door handle causes the cable to slide longitudinally in the sheath so as to pull on the trigger which, in turn, either directly or indirectly (i.e., via some intermediate linkages which are not a part of the present invention) actuates the latchbolt.

Heretofore, vehicle thieves have been able to actuate cable-driven latches by pulling on the cable system with a thin, break-in device (a.k.a. "Slim Jim") which is inserted through the window slot in the door. To prevent access to the cable system by thieves, vehicle manufacturers have provided shields, or the like, in the door to block access to the cable system by, or otherwise thwart, such break-in devices. Such shields add cost and weight to the vehicle.

SUMMARY OF THE INVENTION

The present invention contemplates a vehicle door latch and handle mechanism including a cable-driven door latch wherein the sheath encasing the cable pushes on the trigger to actuate the latchbolt, in contrast to the cable pulling on such trigger. More specifically, the present invention involves a cable-driven door latch and handle mechanism comprising a latchbolt for engaging a striker on a doorway frame to prevent unintended opening of the door, a trigger for directly or indirectly actuating the latchbolt, and a handle remote from the trigger for actuating the trigger. The handle is carried on a support for movement with respect thereto. A flexible cable extends between the handle and the door latch, and is encased in a flexible sheath which has sufficient longitudinal (i.e., along its length) incompressibility that it can press on and move the trigger without yielding or collapsing significantly under the force required to move the trigger. One end of the cable is attached to the handle for movement with the handle, while the other end of the cable is anchored against longitudinal movement adjacent the trigger. One end of the sheath is anchored against movement to the support for the handle and adjacent the end of the cable attached to the handle, while the other end of the sheath is attached to the trigger. The sheath has a length greater than the shortest distance between the trigger and the handle, and extends between the trigger and the handle by a first arcuate path characterized by a first radius when the latch is engaging the striker, and by a second arcuate path having a second radius which is greater than the first radius when the cable is tensioned by actuating the handle to disengage the latchbolt from the striker. In this latter regard, upon tensioning of the cable by pulling on or rotating the handle, the sheath is caused to straighten sufficiently that the other end of the sheath attached to the trigger is caused to move toward the other end of the cable which is anchored adjacent the trigger, and in so doing, pushes upon the trigger and actuates the latchbolt. The arcuate paths of the sheath may include more than one arc and hence form a serpentine path between the handle and trigger. The striker may reside on any part of the doorway frame (i.e., the jamb, door sill or lintel). Preferably, the latchbolt and trigger are both rotateable, and the striker is secured to the jamb opposite the jamb to which the door is hinged.

BRIEF DESCRIPTION OF THE DRAWINGS

The invention will better be understood when considered in the light of the following detailed description of a specific embodiment thereof which is given hereafter in connection with the attached drawing which is a partially broken away isometric view of a latch, cable system and handle mechanism according to the present invention.

DESCRIPTION OF THE PREFERRED EMBODIMENTS

The Figure shows the inside of a vehicle door 2 supporting a latching mechanism 4 including a rotateable latchbolt 6 contained within a housing 7 mounted on a frame member 9, and adapted to engage a striker 8 on a door jamb 10 of a vehicle, such as described in the above-referenced patents. The mounting frame member 9 carries the housing 7 as well as the several other linkages of the latch such that the latch 4 can be preassembled and then attached as a unit to the door 2. The latchbolt 6 preferably takes the form of a fork-bolt and engages the striker 8 when the door 2 is in the closed position so as to retain the door 2 in such position against unintended opening thereof. To open the door 2, the latchbolt 6 is caused to rotate so as to disengage the striker 8 by actuation of the latchbolt 6 by an operating lever (hereinafter trigger 12). The trigger 12 may either directly actuate the latchbolt 6, or indirectly actuate the latchbolt 6 via appropriate linkages therebetween as are well known in the art and are not themselves part of the present invention. The trigger 12 is actuated by a cable system 14 which extends from the trigger 12 to a remotely located handle 16 carried by a support 18 which may either be (1) a part of the door 2, or (2) a separate piece secured to the door 2 as shown. The handle 16 is rotateable about a spindle 20, and includes (1) a grasping portion 22 which is manipulated by the vehicle entrant, and (2) a lever portion 24 integral with, and extending at an angle to, the grasping portion 22 inwardly of the door 2. The lever portion 24 has an aperture 26 therein which carries a plastic grommet 28 which, in turn, receives an end 34 of the cable 32.

The cable system 14 comprises a sheath 30 and a cable 32 which slides longitudinally within the sheath 30. A first end 34 of the cable 32 is attached in the grommet 28 (e.g., by bending), so as to be rotateable therein when the grasping portion 22 is moved outwardly and the lever portion 24 moved in concert therewith away from the leg 23 of the support 18. The second end 36 of the cable 32 is anchored to the end wall 38 of the door 2, preferably in alignment with the sheath 30, so as to prevent longitudinal movement of the cable 32 (i.e., in its lengthwise direction). Alternatively, the second end 36 of the cable 32 could be secured to the frame 9 for the latch 4, by simply increasing the size of the frame 9 sufficiently to cover the site on the wall 38 where the end 36 is attached to the wall. The sheath 30 has a first end 40 anchored against movement to the handle support 18 adjacent the first end 34 of the cable 32. The second end 42 of the sheath is affixed to the trigger 12 via a junction block 44 which rotates through a limited angle as the trigger 12 rotates about a spindle 46. The cable system 14 is flexible transverse its length, and extends between the handle support 18 and the trigger 12 in a first arcuate path 15 (shown in solid lines) characterized by a first radius when the handle 16 is in its normal resting position. When the handle 16 is actuated by pulling on the grasping portion 22, and hence pulling on the cable 32 via the lever 34, the cable system 14 is caused to straighten somewhat and move to a position such as illustrated at 17 in phantom. As the cable system moves from the first arcuate path 15 (whose arc is defined by the first radius) to a somewhat flatter arcuate path (defined by a second radius which is greater than the first radius), the end 42 of the sheath 30 is caused to move toward the anchored end 36 of the cable 32.

The cable system 14 will generally be of the type commonly used in vehicles for cable-driven door latches, and will preferably use a heavy duty cable such as a conventional 1×19 coated wire type cable encased in a braided-metal-wire type sheath of the flat-wrap for lag-wire type. Such sheaths are flexible enough to readily move laterally from the positions 15 and 17 indicated in the drawing when the cable is tensioned, yet are sufficiently incompressible in the longitudinal direction as to be able to apply sufficient force to the trigger 12 to push and cause rotation thereof about the spindle 46 so as to actuate the latchbolt 6 and disengage it from the striker 8. Such cable systems are commercially available from such sources as the Grand Rapids or Capro companies.

While the invention has been disclosed primarily in terms of a specific embodiment thereof it is not intended to be limited thereto but rather only to the extent set forth hereafter in the claims which follows.

We claim:

1. In a cable-driven door latch and handle mechanism comprising a latchbolt for engaging a striker on a doorway frame to prevent unintended opening of said door, a trigger for actuating said latchbolt, a moveable handle remote from said trigger for actuating said trigger, a support for said handle, a flexible cable extending between said handle and said door latch, and a flexible sheath encasing said cable, the improvement comprising a first end of said cable being attached to said handle for movement with said handle, a second end of said cable being anchored adjacent said trigger so as to prevent longitudinal movement of said second end, a first end of said sheath being anchored against movement adjacent said first end of said cable, and a second end of said sheath being attached to said trigger, said sheath having a length greater than the direct distance between said trigger and said handle and extending between said trigger and said handle by a first arcuate path having by a first radius when said latch is engaging said striker and by a second arcuate path having a second diameter greater than said first diameter when said cable is tensioned, whereby upon tensioning of said cable by actuating said handle said sheath is caused to straighten sufficiently that said second end of said sheath is caused to push upon said trigger and actuate said latchbolt.

2. The door latch and handle mechanism according to claim 1 wherein said arcuate path is a serpentine path.

3. The door latch and handle mechanism according to claim 1 wherein said doorway frame includes a door jamb, and said striker is attached to said jamb.

4. The door latch and handle mechanism according to claim 1 wherein said trigger is caused to rotate to actuate said latch upon tensioning of said cable and straightening of said sheath.

5. The door latch and handle mechanism according to claim 4 wherein said latchbolt rotates to engage/disengage said striker.

* * * * *